US005553364A

United States Patent [19]

Nakagawa

[11] Patent Number: 5,553,364

[45] Date of Patent: Sep. 10, 1996

[54] HEAT PROCESSING APPARATUS FOR PILE SHEET

[76] Inventor: Chieko Nakagawa, 442-3, Ooazaawaga, Annocho, Aki-gun, Mie-Pref., Japan

[21] Appl. No.: 456,047

[22] Filed: May 31, 1995

[51] Int. Cl.[6] ..... D06C 23/00; D06C 23/04

[52] U.S. Cl. ..... 26/2 R; 26/69 R; 28/160

[58] Field of Search ..... 26/2 R, 16, 30, 26/69 R, 3, 4; 28/160, 159, 163, 165

[56] References Cited

U.S. PATENT DOCUMENTS

| | | | |
|---|---|---|---|
| 2,524,604 | 10/1950 | Seemuller | 26/69 R |
| 3,641,635 | 2/1972 | Martin | 26/69 R |
| 3,729,784 | 5/1973 | Mazzone et al. | 26/2 R |
| 3,785,016 | 1/1974 | Hergert | 26/69 R |
| 3,916,823 | 11/1975 | Halloran | 26/2 R |
| 4,084,026 | 4/1978 | Gandia | 28/160 |
| 4,112,560 | 9/1978 | Willbanks | 28/160 |
| 4,147,507 | 4/1979 | Laus | 28/160 |
| 4,576,611 | 3/1986 | Pascoe, Sr. | 26/2 R |
| 5,099,553 | 3/1992 | Dischler | 26/2 R |

*Primary Examiner*—Amy B. Vanatta
*Attorney, Agent, or Firm*—Moonray Kojima

[57] ABSTRACT

The invention discloses a heat processing apparatus for processing the surface in undulated form and expressing a pattern in a pile sheet having multiple piles on a base cloth, in particular, a pile sheet having piles composed of synthetic fibers, which comprises conveying means for conveying the pile sheet, heating means for heating the pile sheet during the conveying process, and pressing means provided on the conveying route for pressing the pile to the base cloth side by selectively pressing different ones of the piles of heated pile sheet to deform the piles, in which the processing for expressing a pattern by undulating the surface of the pile sheet forming multiple piles on the base cloth is done efficiently and simply by useing a plurality of elements in the pressing means.

7 Claims, 9 Drawing Sheets

HEAT PROCESSING APPARATUS FOR PILE SHEET

SUMMARY OF THE INVENTION

The present invention relates to a heat processing apparatus for processing the surface in of a pile sheet comprising multiple piles on a base cloth.

BACKGROUND OF THE INVENTION

To corrugate the surface of a conventional pile sheet, for example, an apparatus such as shown in FIG. 8 is used. In this apparatus, a rotary roll 101, a spiral cutter 102 and a lower blade 103 are disposed as shown. When a spiral sheet 104 is conveyed in between the rotary roll 101 and spiral cutter 102, the front end of piles 105 is cut off by the spiral cutter 102 and lower blade 103.

The rotary roll 101 is undulated by integrally forming coils 106 on the surface, for example, as shown in FIG. 9. Thus, corresponding to the coils 106 are cut shorter than other piles 105, so that the surface of the pile sheet 104 is undulated.

When the pattern is formed by cutting the piles 105, removing the waste cuttings of cut piles 105 is indispensable. This takes time in processing. Besides, the waste cuttings of the pile 105 are very tiny and light, floating in the air, and, hence, the working environment is contaminated.

Moreover, the spiral cutter 102 and lower blade 103 must be sharpened after a number of uses. Thus, work must be interrupted, and the processing takes a very long time.

OBJECT OF THE INVENTION

It is a primary object of the invention to provide a heat processing apparatus for pile sheet which is capable of preventing discharge of waste cuttings of piles as in the prior art by undulating the surface of pile sheet by pressing and deforming by pressing means heated by heated means, thereby eliminating the step of scraping off waste cuttings from the pile sheet and facilitating the job, while keeping the working environments clean. Moreover, an object is to eliminate the necessity to repeatedly grind the spiral cutter or lower blade so that work will not be interrupted, and the operation efficiency is enhanced.

It is another object of the invention to provide heat processing apparatus for pile sheet which is capable of accelerating the pile sheet conveying speed and thereby raise the working efficiency, by heating the pile sheet gradually in a heating chamber so as not to load the pile sheet.

It is a different object of the invention to provide a heat processing apparatus for pile sheet which is capable of shortening the conveying route and reducing the size of the apparatus, by use of pressing means immediately after heating the pile sheet by heating means.

It is a further object of the invention to provide a heat processing apparatus for pile sheet which is capable of obtaining fine undulated patterns by means pressing means back and forth to a desired extent using a fluid cylinder by disposing multiple elements densely provide in the overall length in the width direction of the pile sheet, and thereby obtaining fine patterns in pile sheets of long piles or short piles, by adjusting the element projecting extent depending on the pile sheet.

Other objects of the invention will be better understood from the following detailed description taken in conjunction with the drawings.

EMBODIMENTS

Figure 1:
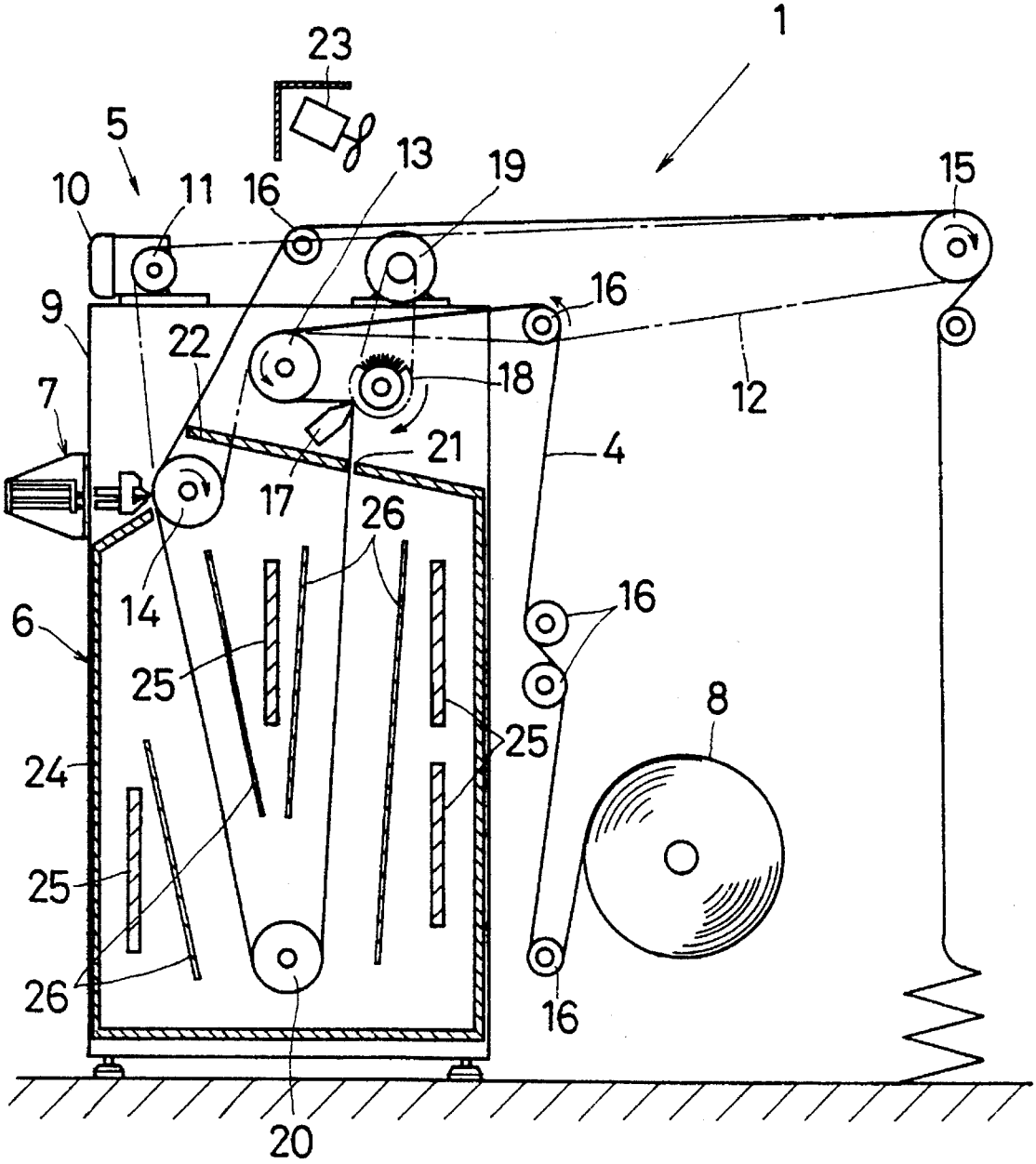
FIG. 1 is a structural explanatory diagram showing a heat processing apparatus for pile sheet of the invention.

Referring now to the drawings, an embodiment of the invention is described in detail below.

FIG. 1 schematically shows a heating apparatus for pile sheet 1 (hereinafter called apparatus), in which a pattern is expressed by undulating the surface of a pile sheet (see FIG. 2) forming multiple piles 3 on a base cloth 2 (see FIG. 2). In the pile sheet 4 to be processed, preferably, piles 3 composed of synthetic fibers such as acryl and polyester are formed.

As shown in FIG. 1, the apparatus 1 comprises conveying means 5 for conveying the pile sheet 4, a heating chamber 6 as heating means for heating the pile sheet 4 during the conveying process, and an element unit 7 (see FIG. 2) as pressing means for pressing piles 3 to the base cloth 2 side by projecting back and forth to the piles 3 of the heated pile sheet.

The conveying means 5 is for conveying a cloth roll 8 on which the pile sheet 4 is wound in a specified conveying route, and by driving a sheet feed motor 10 with reduction gear fixed on a casing 9, the torque is transmitted from a drive pulley 11 of the sheet feed motor 10 to each pulley (not shown) through a V-belt 12, thereby rotating a first guide roller 13, a support roller 14, and a winding roller 15 simultaneously. In the space from the rear stage of the first guide roller 13 to the vicinity of the support roller 14, the heating chamber 6 is formed.

The first guide roller 13 is designed to feed the pile sheet 4 conveyed from the cloth roll 8 through plural rollers 16 . . . at an acute angle in the front stage of the heating chamber 6. All of the piles 3 of the pile sheet 4 are raised and aligned in one direction by an aligning head 17 and an aligning brush 18 disposed in the rear stage of the first guide roller 13. The aligning head 17 abuts against the back side (base cloth 2 side) of the pile sheet 4 conveyed at an acute angle, and feeds at a further acute angle. The aligning brush 18 is mounted so as to be free to move in and out in the aligning head 17 direction by use of an air cylinder (not shown), and is rotated by a brush motor 19.

In the rear stage of the aligning head 17 and aligning brush 18, a second guide roller 20 is mounted. This second guide roller 20 is positioned downward in the long heating chamber 6, and sends the pile sheet 4 conveyed from an inlet 21 in the upper part of the heating chamber 6 (shown as a V form) in the heating chamber 6. Thus, while decreasing the occupied floor area of the apparatus 1, heating is sufficiently done to a specified temperature.

The support roller 14 is mounted on an outlet 22 in the upper part of the heating chamber 6, and receives the back side of the pile sheet 4, and sends the pile sheet 4 to a winding roller 15 through rollers 16. This winding roller 15 droops downward the wound pile sheet 4.

In the midst of being conveyed to the winding roller 15, the heated pile sheet 4 with deformed piles is cooled by proper forced cooling means 23 composed of blowing fan or the like provided above the casing 9. Thus, the form of the deformed piles 3 is stabilized rapidly, and deformation is set securely.

The heating chamber 6 is intended to heat the conveyed pile sheet 4 to a specified temperature so that the piles 3 may be in a state ready to be deformed in a prior stage of shrinkage and melting, for example, about 200 degrees, and it is enclosed by insulating materials 24 in the casing 9, and plural panel heaters 24 are properly disposed inside so as to heat the pile sheet 5 to specified temperature. Soaking plates 26 are disposed between the panel heaters 25 and conveying route, so as to transmit the heat uniformly by shutting off any direct flame.

Figure 2:
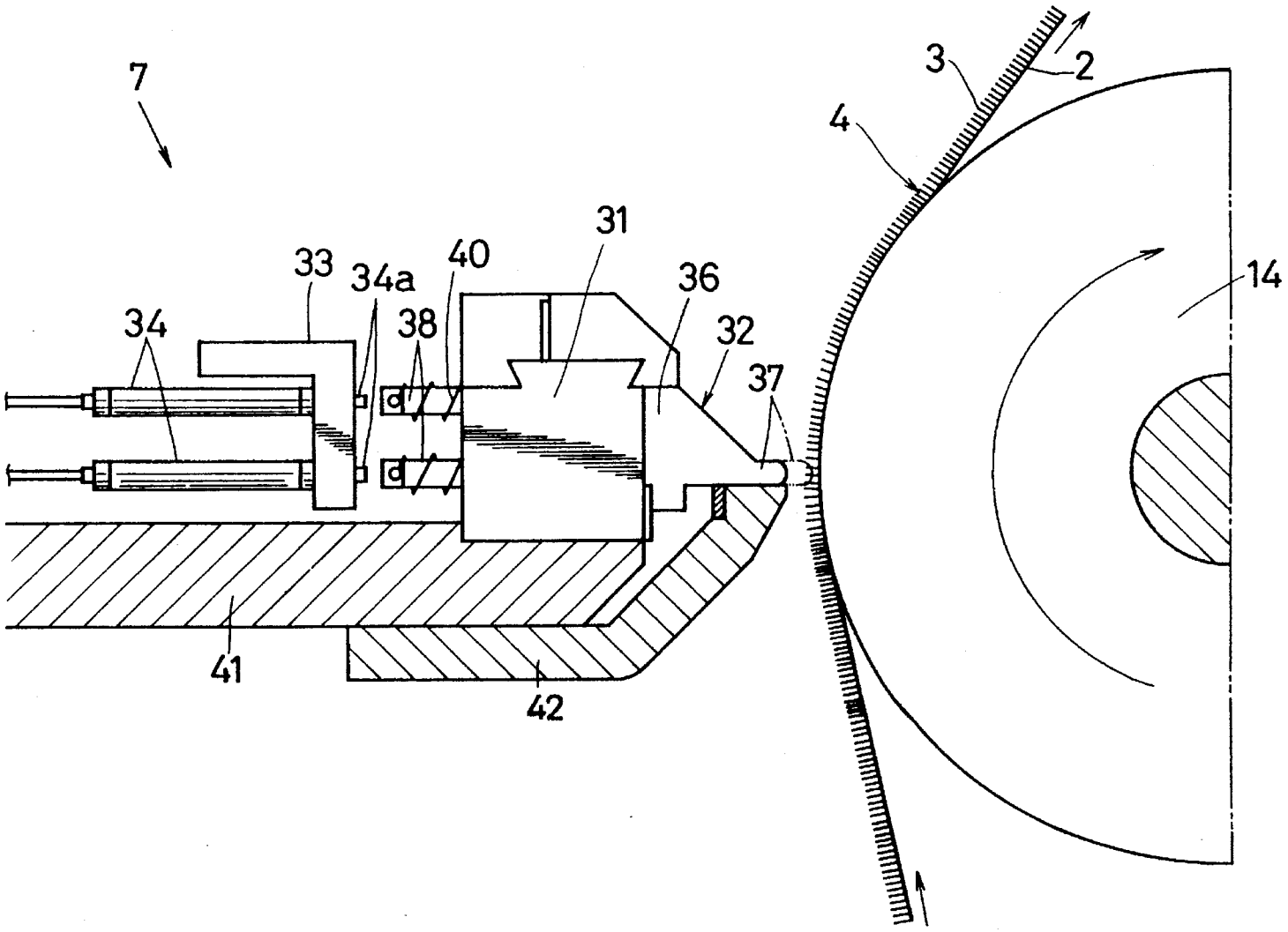
FIG. 2 is a side view of an element unit.
Figure 3:
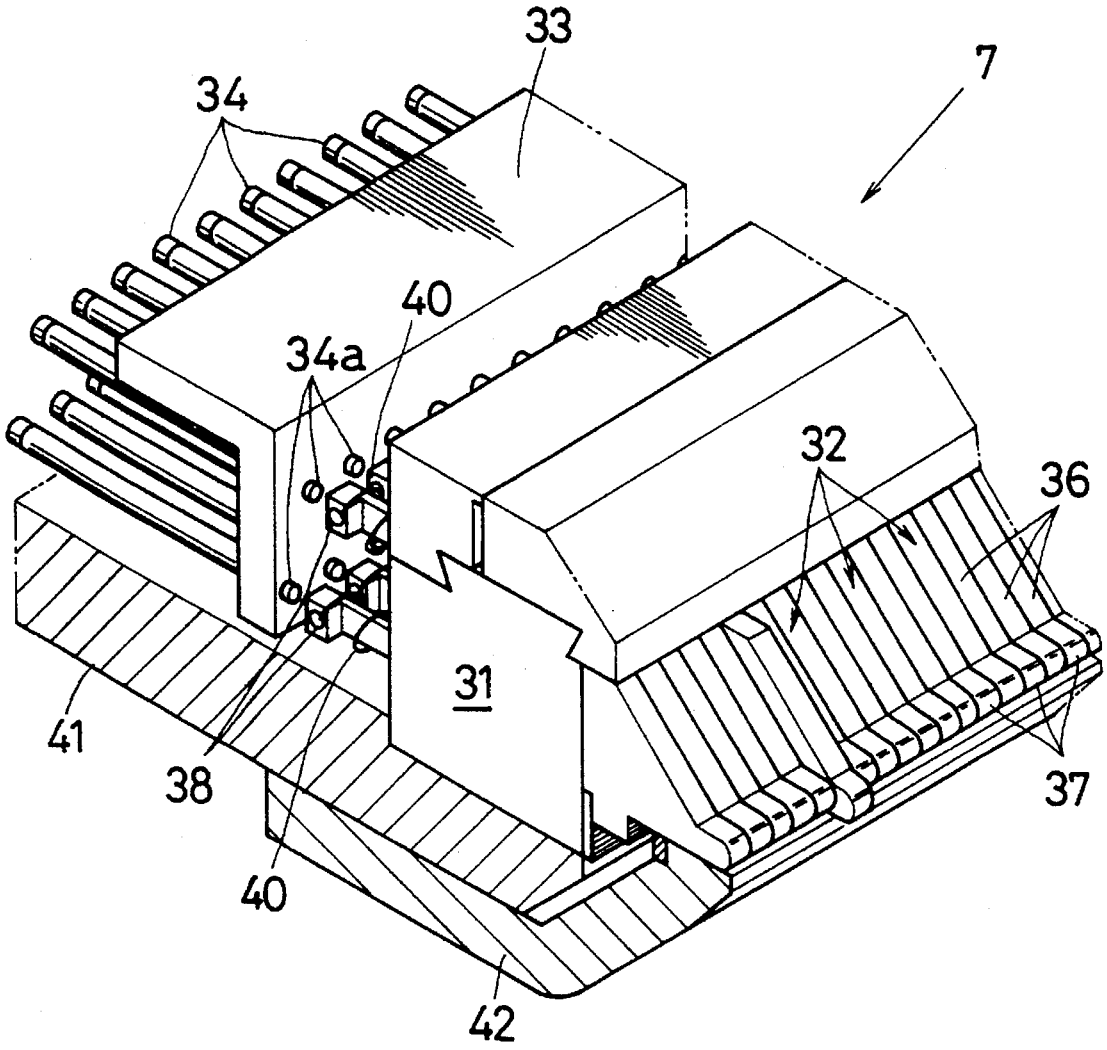
FIG. 3 is a perspective view of the element unit.

The element unit 7 is composed as shown in FIG. 2 and FIG. 3. More specifically, multiple elements 32 slidably accommodated in the element block 31 and disposed densely and without space therebetween in the front end portion in the overall length in the width direction of the pile sheet 4 are designed to be projected back and forth to the piles 3 of the pile sheet 4 by use of multiple air cylinders 34 mounted on a cylinder mounting block 33 supporting behind the element block 31.

Figure 4:
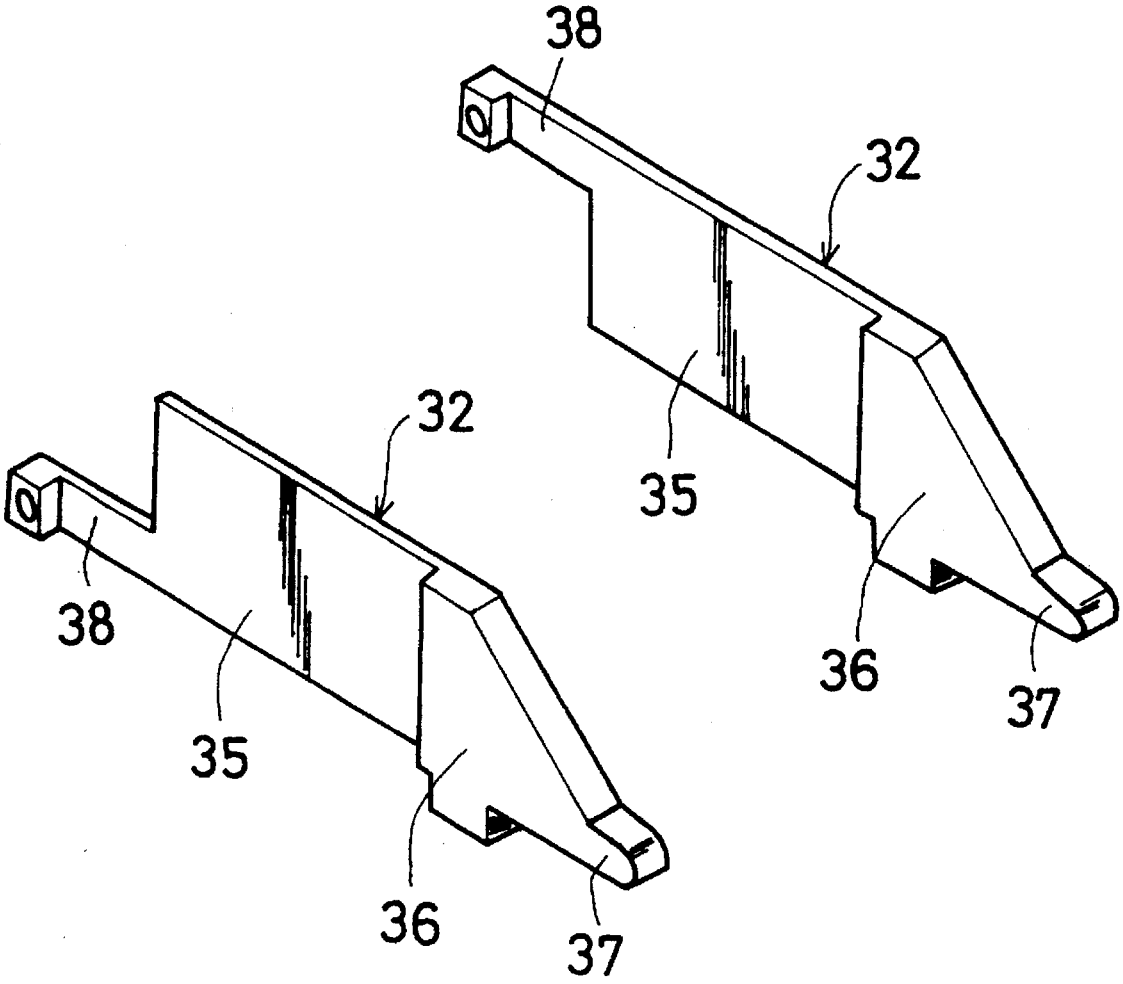
FIG. 4 is a perspective view of an element.

The elements 32 integrally form a head 36 of thick wall at the front end of a rectangular thin wall main body 35 as shown in FIG. 4, and press the piles 3 by a pressing part 37 formed in an arc form. At the rear end of the thin wall main body 35, leg parts 38 are integrally formed so as to be mutually offset in the adjacent elements 32. That is, as shown in the drawing, for example, the element 32 having the leg part 38 formed integrally at the lower side of the thin wall main body 35, and the element 32 having formed integrally at the upper side of the thin wall main body 35, and are formed, the leg parts 38 of the adjacent elements 32 are mutually deviated when accommodated in the element block 31.

Figure 5:
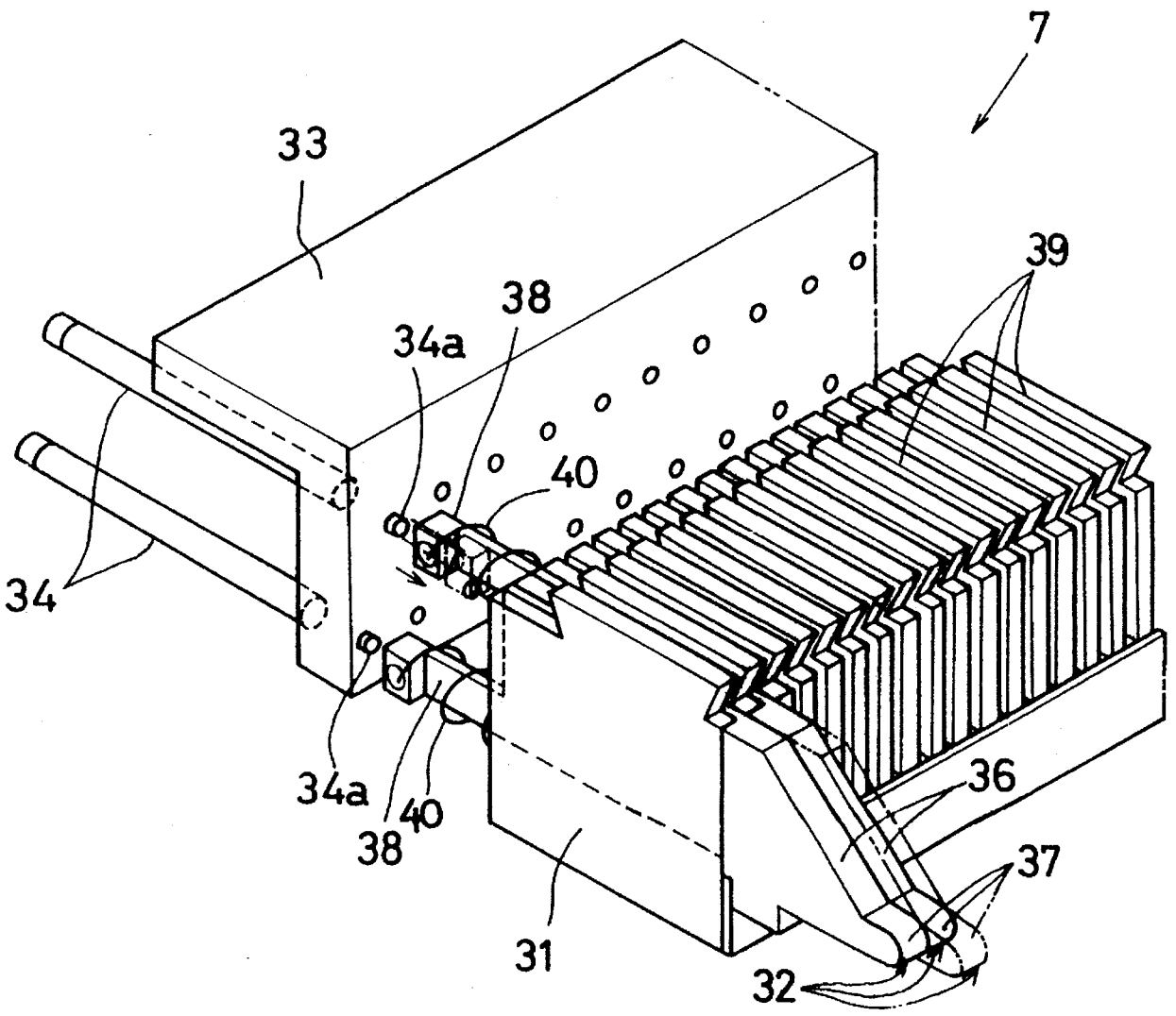
FIG. 5 is a perspective view showing operation of the element unit.

The element block 31 forms multiple slits 39 extending in the longitudinal direction as shown in FIG. 5, so that the thin wall main body 35 of the element 32 is slidable. The elements 32 accommodated in the element block 31 are thrust backward by a spring 40 attached to the leg part 38, and thrusts a pressing part 37 in retreat state. By driving the air cylinders 34 and pushing out the piston rods **34*a*, the element 32 projects forward depending on the extruding amount, and the pressing part 37 at the front end presses the piles 3 of the pile sheet 5 to the base cloth 2 side as indicated by the virtual line in FIG. 2. In FIG. 2 and FIG. 3, meanwhile, reference numeral 41 is a support base, and 42 is a guide block for supporting and guiding the pressing part 37 of the element 32**.

The air cylinder 34 is driven by controlling selection of the air cylinder 34 to be driven and extruding amount of the piston rod **34*a*** by a proper control device (not shown).

Figure 6:
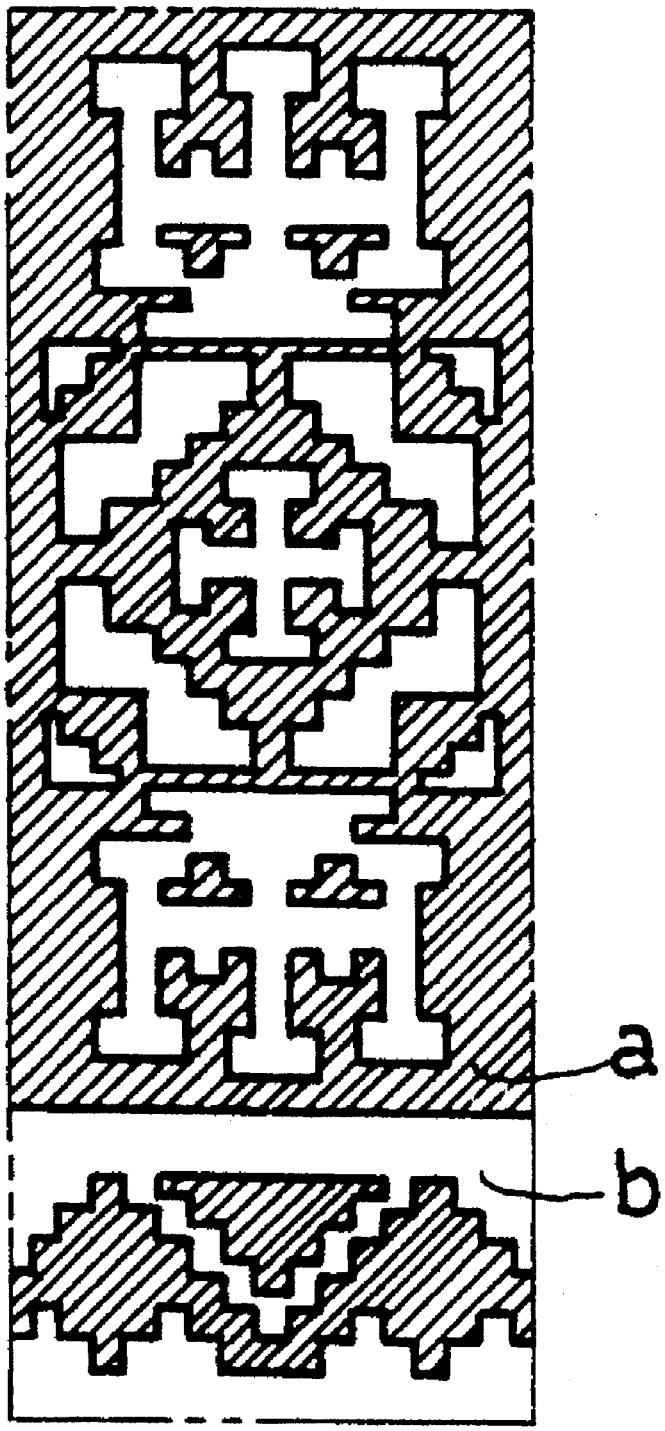
FIG. 6 is an explanatory diagram showing an example of pattern.

FIG. 6 shows an example of a pattern formed in the pile sheet 4, and a desired pattern is obtained by the control device, for example, long piles 3 in the shaded area a and short piles 3 in the blank area b.

By using such element unit 7 as the pressing means, fine undulated patterns can be formed, and by adjusting the projecting extent of the elements 32 depending on the pile sheet 4, desired fine undulated patterns can be obtained whether in the pile sheet 4 with long piles or in the short pile sheet 4.

Figure 9:
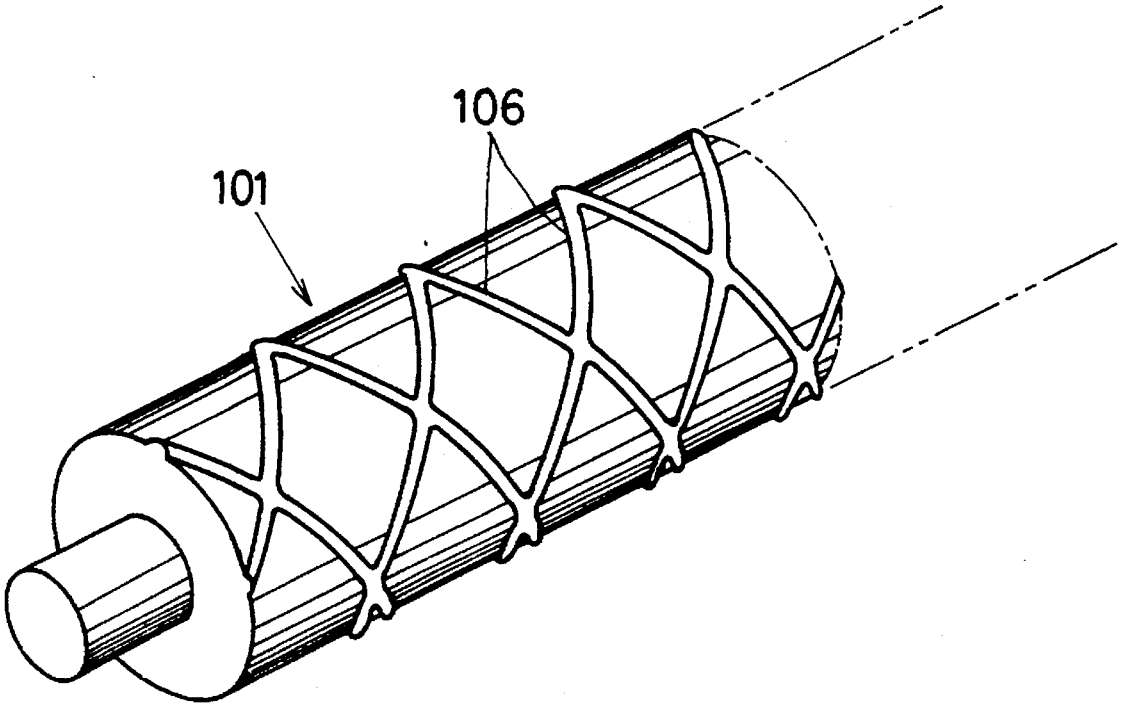
FIG. 9 is a perspective view of a rotary roll shown in FIG. 8.

Instead of the element roller used as pressing means, a conventional punching roller (see FIG. 9) may be also used. It may be mounted on a support roller 14 and rotated.

In thus constituted apparatus 1, the pile sheet 4 conveyed by the conveying means 5 is heated in the heating chamber 6 in the conveying process, and multiple piles 3 on the base cloth 2 are ready to be deformed in a prior stage of shrinkage and melting. When leaving the heating chamber 6, it is pressed by the pressing part 37 of the element unit 7, and the piles 3 are deformed by shrinkage or the like depending on the pressing conditions. Accordingly, processing of the pile sheet 4 into an undulated surface is different from the conventional cutting, and waste cuttings of piles 3 are not formed. It hence eliminates the scraping off of the waste cuttings from the pile sheet 4, and the processing is facilitated. Besides, since waste cuttings are not released, the working environments are kept healthy and a comfortable work place is attained.

Moreover, since it is not necessary to grind the spiral cutter and blower blade as required in the prior art, the job is not interrupted, and the operation efficiency is enhanced.

Furthermore, since the pile sheet 4 is heated gradually in the heating chamber 6, the conveying speed of the pile sheet 4 is accelerated without loading the pile sheet 4, working efficiency is enhanced.

Figure 7:
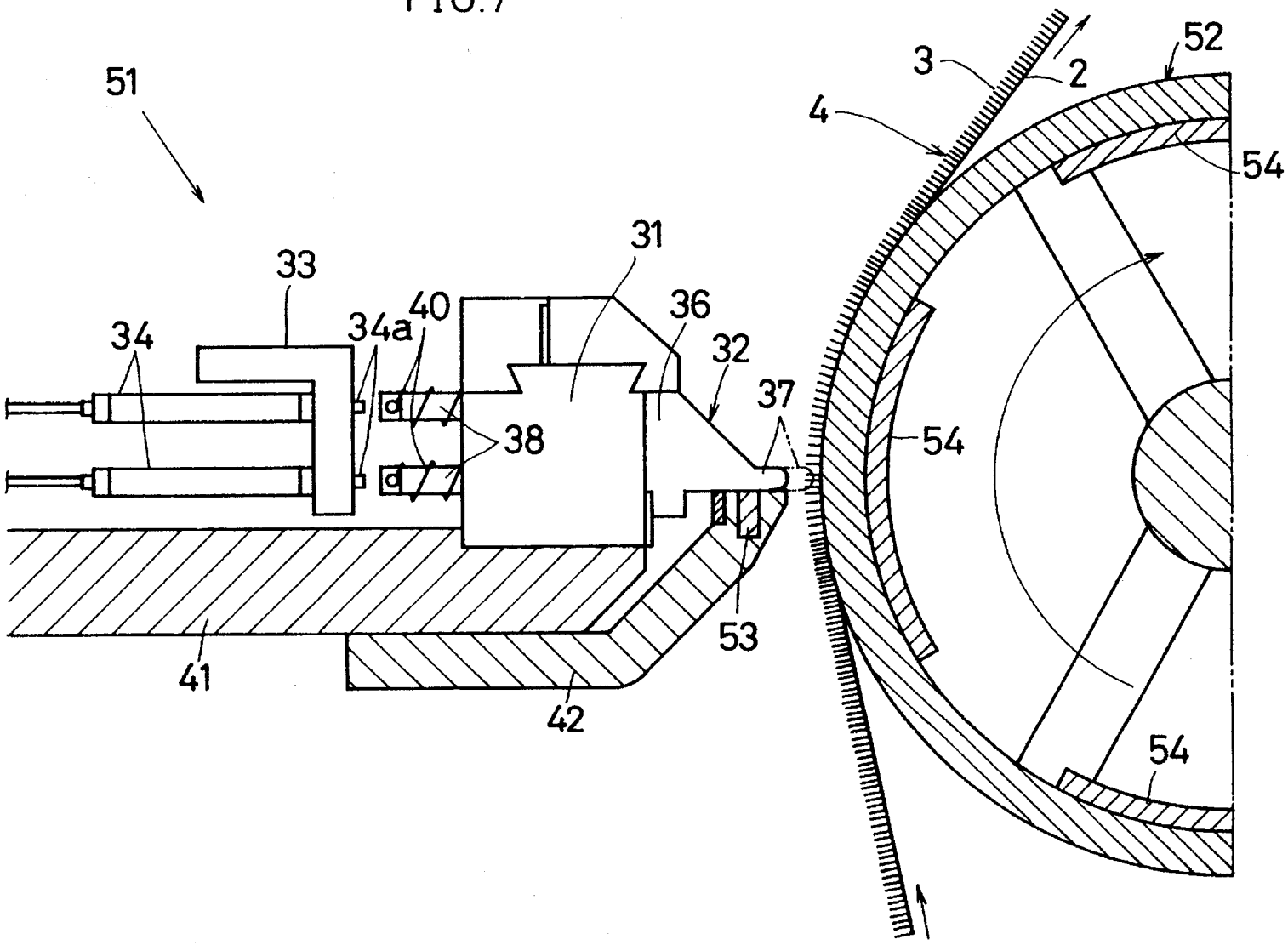
FIG. 7 is a side view showing other embodiment of heating means.
Figure 8:
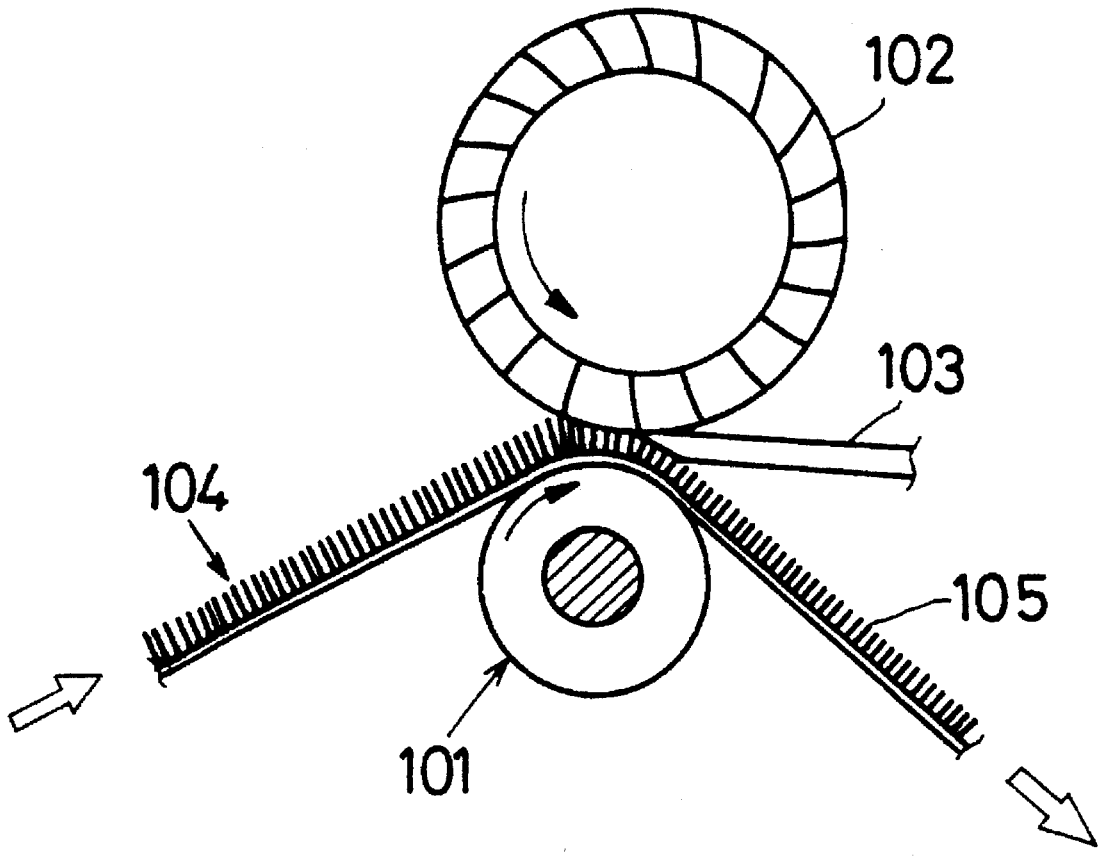
FIG. 8 is an explanatory diagram of prior art.

FIG. 7 shows another embodiment of heating means, comprising a heating element unit 51 for heating the element 32 to be heated, and a heating support roller 52 which is a support roller to be heated. To compose the heating element unit 41, for example, a panel heater 53 is buried in a guide block 42 and heat is conveyed to the element 32. The heating support roller 52, for example, me be formed of a hollow structure with a panel heater 54 is installed at the inner side. In the rear case, panel heater may be disposed to confront the peripheral surface of the support roller 14.

Using such heating means, after the pile sheet 4 is heated, it is immediately pressed by the pressing means. Therefore, the conveying route is short, and the apparatus 1 may be reduced in size.

Instead of forming the heating means in both heating element unit 51 and heating support roller 52, it may be composed at one side only. Or the heating means may be also formed together with the heating chamber 6.

Showing the corresponding relation between the constitution of the invention and the constitution of the embodiment above, the heating means of the invention corresponds to the heating chamber 6, heating element unit 51, and heating support roller 52 in the embodiment, the pressing means corresponds to the element unit 7, and heating element unit 51, the support member corresponds to the support roller and heating support roller 52, the heating element corresponds to the panel heater 52, and the fluid cylinder corresponds to the air cylinder 343.

What is claimed is:

1. A heat processing apparatus for pile sheets, comprising:

conveying means for conveying a pile sheet comprising a plurality of piles on a base cloth;

heating means for heating said pile sheet while being conveyed by said conveying means; and pressing means provided adjacent said conveying means for pressing selected ones of said plurality of piles to said base cloth by pressing the heated pile sheet, wherein said pressing means comprises a plurality of elements controllable in a manner and in the direction of the length of said piles so as to selectively form a desired pattern in said pile sheet.

2. The apparatus of claim 1, wherein said heating means comprises a heating element located in a heating chamber disposed near said conveying means.

3. The apparatus of claim 1, further comprising a support means disposed opposite to said pressing means, and wherein said heating means comprises means for heating either said pressing means or said support means.

4. The apparatus of claim 1, wherein said pressing means comprises:

a plurality of elements having a thin wall main body slidably accommodated in a slit in an element block and a thick wall head for pressing said plurality of piles to said base cloth, and being formed integrally with said thin wall main body, said thick wall heads of said plurality of elements being disposed in the length direction of said plurality of piles;

leg parts integrally formed opposite of said thick wall head in said thin wall main body so as to offset each other in adjacent locations; and a cylinder mounting block provided on one side of said thick wall head of said element block and provided with a piston rod and confronting each leg part.

5. A heat processing apparatus for pile sheet, comprising:

conveying means for conveying a pile sheet comprising a plurality of piles on a base cloth;

heating means for heating the pile sheet while being conveyed by said conveyor means; and pressing means provided adjacent said conveying means for pressing said plurality of piles to said base cloth by pressing said heated pile sheet; wherein said pressing means comprises:

a plurality of elements having a thin wall main body slidably accomodated in a slit in an element block and a thick wall head for pressing said plurality of piles to said base cloth, and being formed integrally with said thin wall main body, said thick wall heads of said plurality of elements being disposed in the length direction of said plurality of piles;

leg parts integrally formed opposite to said thick wall head in said thin wall main body so as to offset each other in adjacent locations; and a cylinder mounting block provided on one side of said thick wall head of said element block and provided with a piston rod and confronting each leg part.

6. The apparatus of claim 5, wherein said heating means comprises a heating element located in a heating chamber disposed near said conveying means.

7. The apparatus of claim 5, further comprising a support means disposed opposite to said pressing means, and wherein said heating means comprises means for heating either said pressing means or said support means.

* * * * *